US010913526B2

(12) United States Patent
Clark

(10) Patent No.: US 10,913,526 B2
(45) Date of Patent: Feb. 9, 2021

(54) FRESH WATER BOAT CHILLER SYSTEM

(71) Applicant: Kevin J. Clark, Fort Myers, FL (US)

(72) Inventor: Kevin J. Clark, Fort Myers, FL (US)

( * ) Notice: Subject to any disclaimer, the term of this patent is extended or adjusted under 35 U.S.C. 154(b) by 104 days.

(21) Appl. No.: 16/444,494

(22) Filed: Jun. 18, 2019

(65) Prior Publication Data

US 2020/0398965 A1 Dec. 24, 2020

(51) Int. Cl.
*B63J 2/02* (2006.01)

(52) U.S. Cl.
CPC ..... *B63J 2/02* (2013.01)

(58) Field of Classification Search
CPC ..... B63J 2/02
See application file for complete search history.

(56) References Cited

U.S. PATENT DOCUMENTS 2,746,272 A * 5/1956 Carpenter ..... A23B 4/066 62/64
2,966,779 A * 1/1961 Lintern ..... B63J 2/04 62/160
3,802,214 A * 4/1974 Prieto ..... B63B 35/24 62/240
3,822,566 A * 7/1974 Lowi, Jr. ..... F28D 7/022 62/435
4,835,977 A * 6/1989 Haglund ..... F25D 17/02 62/89
4,922,724 A * 5/1990 Grayson ..... B63J 2/12 62/135
4,967,569 A * 11/1990 Machen ..... B63J 2/04 62/240
6,044,901 A * 4/2000 Basala ..... A01K 97/05 165/121
6,449,973 B2 9/2002 Dodge et al.
6,701,733 B2 3/2004 Brunner
6,823,684 B2 * 11/2004 Jensen ..... F28D 5/00 62/171
9,885,499 B2 2/2018 Giampiccolo
2002/0017108 A1 2/2002 Schooley
2010/0229585 A1 * 9/2010 Bradford ..... F24F 1/32 62/291
2016/0129983 A1 * 5/2016 Giampiccolo ..... F24F 1/56 165/206
2020/0255306 A1 * 8/2020 Cosentino ..... C02F 1/46104

FOREIGN PATENT DOCUMENTS

CA 2259050 7/1999
WO WO2014/092618 6/2014

* cited by examiner

*Primary Examiner* — Ljiljana V. Ciric
(74) *Attorney, Agent, or Firm* — Edward M. Livingston; Livingston Loeffler, P.A.; Bryan L. Loeffler

(57) ABSTRACT

A boat chiller system (1) wherein a self-contained externally cooled fresh water supply is used in place of water in which the boat is docked, such as seawater, to transfer heat from an interior space of a boat (4) to outside of the boat. The use of recirculated fresh water eliminates barnacle growth in an onboard water cooled a/c system (2) and/or excess barnacles and other sea life from growing near an external water discharge (12) on the boat as would occur with the discharge of heated sea water in a conventional boat a/c system.

18 Claims, 2 Drawing Sheets

FRESH WATER BOAT CHILLER SYSTEM

FIELD OF THE INVENTION

This invention relates to air conditioning systems for cooling boats and more particularly a boat chiller wherein a self-contained externally cooled fresh water supply is provided and used in place of seawater in an onboard water cooled a/c system to prevent barnacle growth.

BACKGROUND OF THE INVENTION

Onboard water cooled a/c systems are air conditioning systems used to remove heat from the interior spaces of boats.

Onboard water cooled a/c systems require two heat transfer steps. A first step is circulating an external supply of water, such as seawater from the ocean, through a compressor to remove heat from refrigerant located within the compressor and then back into the ocean. A second step is circulating an internal supply of freshwater through a pipe system run throughout a boat to remove heat from the interior air of the boat.

As the internal supply of freshwater is circulated it passes though one or more coils that act as radiators to remove heat from air circulated over the coils from the interior space of the boat. The air is circulated via one or more blowers and heat is drawn from the interior space is then transferred to the internal supply of freshwater, and carried by the piping back to an evaporator.

Heat is transferred to refrigerant in the evaporator, thereby cooling the internal supply of freshwater again. The heated refrigerant is compressed in a condenser and then circulated through a condenser coil where the external supply of water removes heat from the refrigerant.

The external supply of water is pumped from a body of water in which the boat is located and circulated over the condenser coil. As the external supply of water is passed through the condenser, heat transfers from refrigerant in the condenser to the external supply of water, which is then pumped overboard as hot water.

Unfortunately, the expelled hot water provides a perfect environment for promoting excess growth of barnacles, sea life and sediment on the boat and even in the piping of the circulation system for the external supply of water. This problem is especially pronounced in seawater, especially when boats are docked for long periods of time.

Therefore, a need exists for a boat chiller wherein a self-contained externally cooled fresh water supply is provided and used in place of seawater in an onboard water cooled a/c system to prevent barnacle growth.

SUMMARY OF THE INVENTION

The primary object of the present invention is to provide a boat chiller wherein a self-contained externally cooled fresh water supply is provided and used in place of seawater in an onboard water cooled a/c system to prevent barnacle growth.

The present invention fulfills the above and other objects by providing a boat chiller having a bypass that connects to an onboard water cooled a/c system for supplying cooled fresh water from a self-contained onshore reservoir to the onboard water cooled a/c system. The onshore reservoir is preferably placed on a dock adjacent to a docked boat having an onboard water cooled a/c system that will be supplied by the onshore reservoir. The onshore reservoir is connected to an onshore chiller that maintains the water within the reservoir at a predetermined cool temperature so the cooled water may be used in place of seawater.

The onboard water cooled a/c system is supplied by bypass valves and an onboard water cooled a/c system circulator that allow the onboard water cooled a/c system to be supplied with water from the onshore reservoir. Connectors, such as quick connect flexible hoses, connect the onshore reservoir to the onboard water cooled a/c system and the bypass supply valves.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
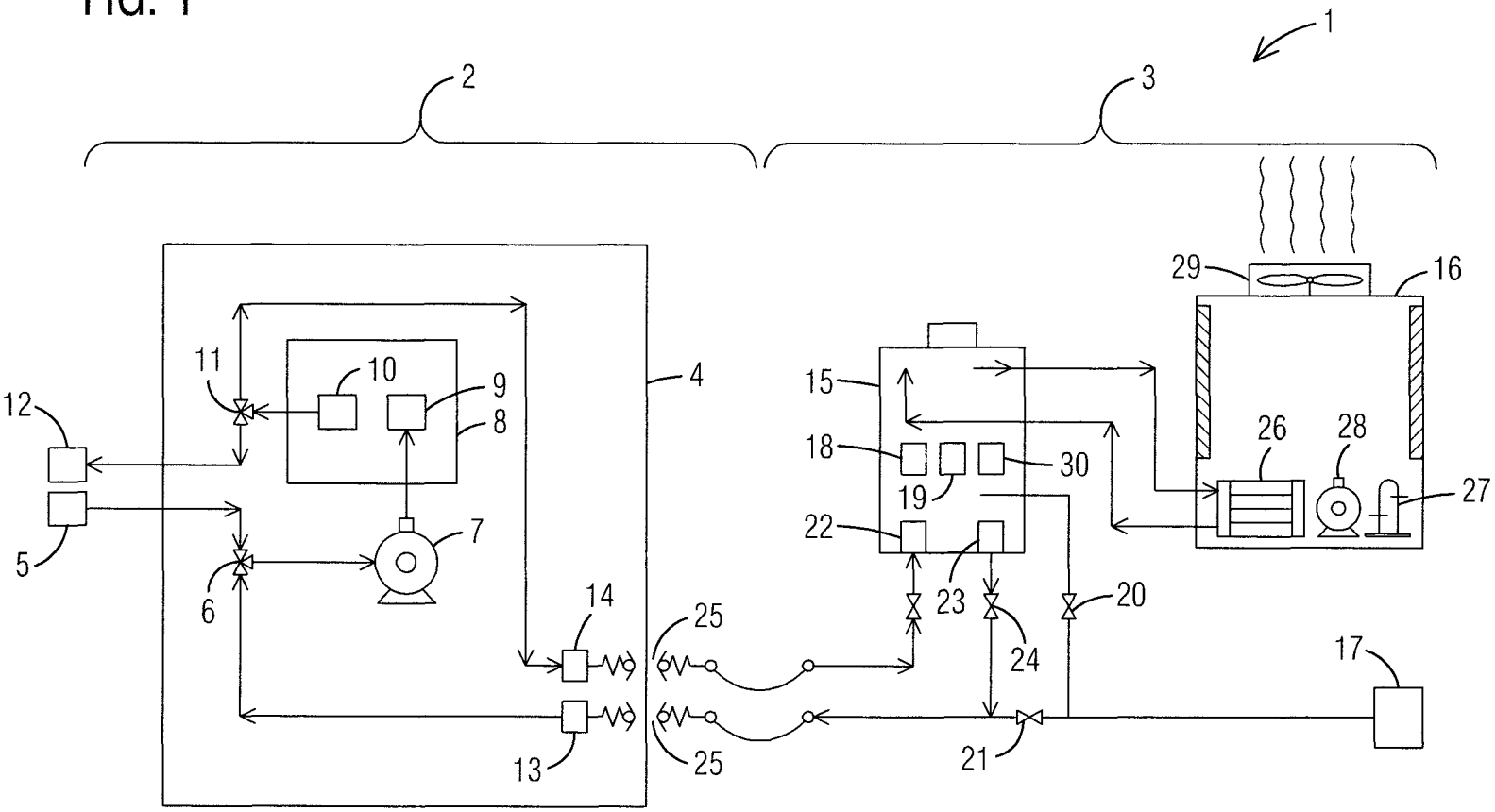
FIG. 1 is a block diagram of a fresh water boat chiller of the present invention.

For purposes of describing the preferred embodiment, the terminology used in reference to the numbered accessories in the drawings is as follows:

1. boat chiller system, generally
2. onboard water cooled a/c system
3. onshore system
4. boat
5. external water supply intake
6. intake bypass valve
7. onboard circulator pump
8. onboard a/c unit
9. onboard evaporator
10. onboard compressor
11. discharge bypass valve
12. external water discharge
13. secondary intake
14. secondary discharge
15. onshore reservoir
16. onshore chiller unit
17. onshore fresh water supply
18. water level sensor
19. temperature sensor
20. first on/off valve
21. second on/off valve
22. reservoir intake
23. reservoir discharge
24. third on/off valve
25. quick connector
26. onshore evaporator
27. onshore compressor
28. circulator pump
29. fan
30. filter
31. dock With reference to FIG. 1, a block diagram of a boat chiller system 1 of the present invention is illustrated. The boat chiller system 1 comprises an onboard water cooled a/c system 2 and an onshore system 3. The onshore system 3 connects the onboard water cooled a/c system 2 to provide fresh, cool and clean water to the onboard water cooled a/c system 2 of a boat 4. Components of the boat chiller system 1 are connected via a plumbing system of pipes, hoses and so forth.

The onboard water cooled a/c system 2 comprises an external water supply intake 5 connected to an intake bypass valve 6, such as a three-way valve, which is connected to an on board circulator pump 7. The onboard circulator pump 7 pumps water from under the boat 4, through an onboard a/c unit 8 having an onboard evaporator 9 and an onboard compressor 10, through a discharge bypass valve 11 and through an external water supply discharge 12 outside of the boat 4 and back into the sea. A secondary intake 13 and secondary discharge 14 are located on the boat 4 and connect the onboard water cooled a/c system 2 to the onshore system 3.

The onshore system 3 comprises an onshore reservoir 15 connected to an onshore chiller unit 16, which are both preferably placed on a dock adjacent to the boat 4 while the boat 4 is docked. The onshore reservoir 15 is connected to an onshore fresh water supply 17, such as municipal water, that provides fresh water to the onshore reservoir 15. A water level sensor 18, such as a float sensor, is located within the onshore reservoir 15 to maintain the water within the onshore reservoir 15 at a required level. A temperature sensor 19 is located within the onshore reservoir 15 and activates the onshore chiller unit 16 if the water temperature drops below a desired level. A first on/off valve 20 is preferably located between the onshore fresh water supply 17 and the onshore reservoir 15. A second on/off valve 21 is preferably located between the secondary intake 13 of the onboard water cooled a/c system 2 and the onshore fresh water supply 17. A reservoir intake 22 and reservoir discharge 23 are located on the onshore reservoir 15 and connected to the secondary intake 13 and secondary discharge 14. A third on/off valve 24, is preferably located between the reservoir discharge 23 and the secondary intake 13. Quick connectors 25 preferably connect the onshore reservoir 15 to the secondary intake 13 and secondary discharge 14 located on the boat.

The onshore reservoir 15 is connected to the onshore chiller unit 16, which comprises an onshore evaporator 26, an onshore compressor 27, an onshore circulator pump 28 and a fan 29. The onshore system 3 may further comprise at least one filter 30 to clean contaminants and debris from the water as it is circulated.

Water chilled by the onshore chiller 16 travels from the onshore reservoir 15 through the secondary intake 13 and through the intake bypass valve 6 to the onboard circulator 7 and onboard a/c unit 8. After passing thought the onboard a/c unit 8, the now heated water travels through the discharge bypass valve 11, through the secondary discharge 14 and back to the onshore system 3.

Figure 2:
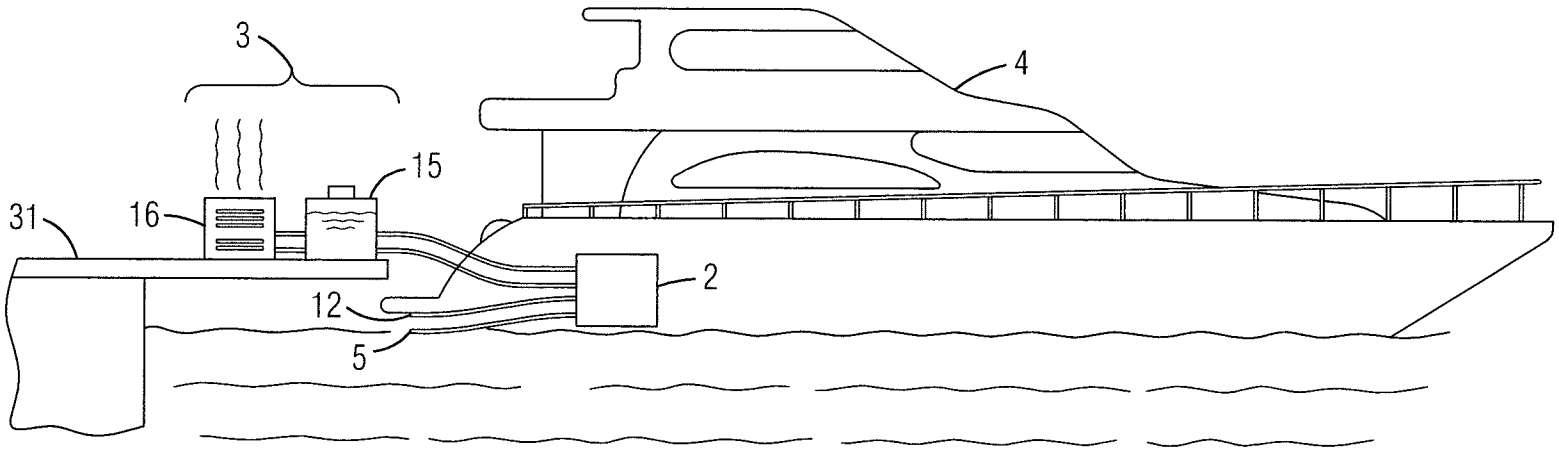
FIG. 2 is a side plan view of a fresh water boat chiller of the present invention in use on a docked boat.

With reference to FIG. 2, a side plan view of a boat chiller system 1 of the present invention in use on a boat 4 while parked at a dock 31. Said dock 31 provides a platform for supporting the onshore system 3 wherein the onshore chiller unit 16 is connected to the onshore reservoir 15 that is supplied by an onshore water supply 17, such as a municipal water source, as illustrated in FIG. 1. The reservoir 15 is connected to the onboard water cooled a/c system 2 located on the boat 4. The onboard water cooled a/c system 2 is also connected to an external water supply intake 5 external water supply intake and an external water supply discharge 12, both of which may be bypassed in favor of fresh water supplied by the reservoir 15 and the onshore chiller unit 16, thereby prolonging the life of the onboard water cooled a/c system 2 by completely eliminating barnacle growth within the piping of the onboard water cooled a/c system 2.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A boat chiller system comprising:

an onboard water cooled a/c system having an external water supply intake connected to an intake bypass valve;

said intake bypass valve being connected to an onboard a/c unit;

said onboard a/c unit having an onboard evaporator and an onboard condenser for transferring heat from an onboard interior space of a boat, on which the onboard water cooled a/c system is installed, to water passing through the onboard a/c unit;

said onboard a/c unit being connected to a discharge bypass valve;

said discharge bypass valve being connected to an external water supply discharge capable of discharging water outside the boat;

an onshore system connected to said onboard water cooled a/c system;

said onshore system having an onshore reservoir for providing fresh water to the onboard a/c;

said onshore reservoir being connected to the intake bypass valve; and said onshore reservoir being connected to the discharge bypass valve.

2. The boat chiller of claim 1 wherein:

said onshore system further comprises an onshore chiller unit.

3. The boat chiller of claim 2 wherein:

said onshore chiller unit having an onshore evaporator, an onshore compressor and a fan.

4. The boat chiller of claim 1 further comprising:

at least one water level sensor located in the onshore reservoir.

5. The boat chiller of claim 1 further comprising:

at least one said temperature sensor located in the onshore system.

6. The boat chiller of claim 1 further comprising:

at least one filter located in the onshore system.

7. The boat chiller of claim 1 further comprising:

at least one onboard circulator pump located in the onboard water cooled a/c system.

8. The boat chiller of claim 1 further comprising:

at least one onshore circulator pump located in the onshore system.

9. A boat chiller comprising:

an onboard water cooled a/c system having an external water supply intake connected to an intake bypass valve;

said intake bypass valve being connected to an onboard a/c unit;

said onboard a/c unit having an onboard evaporator and an onboard condenser for transferring heat from an onboard interior space of a boat, on which the onboard water cooled a/c system is installed, to water passing through the onboard a/c unit;

said onboard a/c unit being connected to a discharge bypass valve;

said discharge bypass valve being connected to an external water supply discharge capable of discharging water outside the boat;

an onshore system connected to said onboard water cooled a/c system;

said onshore system having an onshore reservoir for providing fresh water to the onboard a/c;

said onshore reservoir being connected to the intake bypass valve;

said onshore reservoir being connected to the discharge bypass valve; and said onshore system further comprises an onshore chiller unit having an onshore evaporator, an onshore compressor and a fan.

10. The boat chiller of claim 9 further comprising:

at least one water level sensor located in the onshore reservoir.

11. The boat chiller of claim 9 further comprising:

at least one said temperature sensor located in the onshore system.

12. The boat chiller of claim 9 further comprising:

at least one filter located in the onshore system.

13. The boat chiller of claim 9 further comprising:

at least one onboard circulator pump located in the onboard water cooled a/c system.

14. The boat chiller of claim 9 further comprising:

at least one onshore circulator pump located in the onshore system.

15. A boat chiller comprising:

an onshore system connectable to an onboard water cooled a/c system chiller system located on a boat via an intake bypass and a discharge bypass that circulates water from an onshore reservoir;

said onshore system having an onshore reservoir for providing fresh water to the onboard a/c;

said onshore reservoir being connected to the intake bypass valve;

said onshore reservoir being connected to the discharge bypass valve;

said onshore system further comprises an onshore chiller unit having an onshore evaporator, an onshore compressor and a fan;

at least one onboard circulator pump located in the onboard water cooled a/c system; and at least one onshore circulator pump located in the onshore system.

16. The boat chiller of claim 15 further comprising:

at least one water level sensor located in the onshore reservoir.

17. The boat chiller of claim 15 further comprising:

at least one said temperature sensor located in the onshore system.

18. The boat chiller of claim 15 further comprising:

at least one filter located in the onshore system.

* * * * *